US010052735B2

(12) United States Patent
Kubala et al.

(10) Patent No.: US 10,052,735 B2
(45) Date of Patent: Aug. 21, 2018

(54) IN SITU GRINDING APPARATUS FOR RESURFACING RUBBER BELTS AND ROLLERS

(71) Applicant: APKO TECHNOLOGY, INC., Park City, IL (US)

(72) Inventors: Andrzej Kubala, Prospect Heights, IL (US); Piotr Kubala, Chicago, IL (US); Charles Clickner, Charlotte, NC (US); Christopher Clickner, Clover, SC (US)

(73) Assignee: APKO TECHNOLOGY, INC., Gurnee, IL (US)

( * ) Notice: Subject to any disclaimer, the term of this patent is extended or adjusted under 35 U.S.C. 154(b) by 0 days.

(21) Appl. No.: 14/749,516

(22) Filed: Jun. 24, 2015

(65) Prior Publication Data

US 2016/0375539 A1 Dec. 29, 2016

(51) Int. Cl.

| | |
|---|---|
| ***B24B 7/12*** | (2006.01) |
| ***B24B 5/38*** | (2006.01) |
| ***B24B 5/37*** | (2006.01) |
| ***B24B 5/50*** | (2006.01) |
| ***B24B 7/13*** | (2006.01) |
| ***B24B 5/36*** | (2006.01) |
| ***B24B 55/00*** | (2006.01) |
| ***D06C 21/00*** | (2006.01) |

(52) U.S. Cl.

CPC ..... *B24B 7/12* (2013.01); *B24B 5/363* (2013.01); *B24B 5/366* (2013.01); *B24B 5/37* (2013.01); *B24B 5/38* (2013.01); *B24B 5/50* (2013.01); *B24B 7/13* (2013.01); *B24B 55/00* (2013.01); *D06C 21/005* (2013.01)

(58) Field of Classification Search

CPC ..... B24B 5/36; B24B 5/363; B24B 5/366; B24B 5/37; B24B 5/38; B24B 5/50; B24B 7/12; B24B 7/13; B24B 9/102; B24B 27/0069; B24B 27/0084; B24B 55/00

USPC ..... 451/120, 131, 179, 184, 189, 920

See application file for complete search history.

(56) References Cited

U.S. PATENT DOCUMENTS

| | | | |
|---|---|---|---|
| 1,169,377 | A | 1/1916 | Barnhart |
| 1,429,317 | A | 9/1922 | Louis |
| 1,689,656 | A | 10/1928 | Williams |
| 1,968,550 | A | 7/1934 | Barnes |
| 2,016,590 | A | 10/1935 | Bussing |

(Continued)

FOREIGN PATENT DOCUMENTS

| | | |
|---|---|---|
| DE | 2038392 | 2/1972 |

*Primary Examiner* — Eileen Morgan

(74) *Attorney, Agent, or Firm* — Cherskov Flaynik & Gurda, LLC

(57) ABSTRACT

The present invention provides an apparatus for resurfacing a rotating elastomer substrate. The apparatus utilizes a motorized grinding wheel, said motorized grinding wheel rotating in a direction counter to the rotating elastomer substrate and having an axis of rotation parallel to the axis of rotation of the rotating elastomer substrate, wherein the perpendicular distance between the motorized grinding wheel and the rotating elastomer substrate is adjustable so as to control the amount of elastomer substrate that is removed; and a mount for said motorized grinding wheel, wherein said mount is located proximal to the rotating elastomer substrate that comprises a part of a production line and wherein the mount is capable of traversing parallel to the rotating elastomer substrate.

16 Claims, 7 Drawing Sheets

(56) References Cited

U.S. PATENT DOCUMENTS 2,579,391 A 12/1951 Minarik et al.
3,165,865 A 1/1965 Bousquet et al.
3,456,394 A 7/1969 Welsh
3,653,162 A 4/1972 Clark
3,775,241 A 11/1973 Justus et al.
3,889,424 A 6/1975 Buhayar et al.
4,206,422 A * 6/1980 Fein ..... H01S 3/038 372/88
4,322,916 A * 4/1982 Richmond ..... F16G 1/28 156/137
4,329,192 A * 5/1982 White, Jr. ..... B29D 29/08 156/138
4,575,972 A 3/1986 Ohki et al.
4,941,294 A 7/1990 Nagaki
5,214,881 A * 6/1993 Borchardt ..... B24B 5/50 451/188
5,386,665 A * 2/1995 Heim ..... B24B 7/30 451/304
5,414,963 A * 5/1995 Watanabe ..... B24B 5/50 451/21
5,597,449 A 1/1997 Vestola et al.
5,738,571 A * 4/1998 Kitahama ..... B24B 5/50 451/188
5,853,318 A * 12/1998 Thom ..... B02C 4/30 451/258
6,213,850 B1 * 4/2001 Hashino ..... B24B 5/50 451/188
6,257,964 B1 7/2001 Helgren
6,616,511 B2 9/2003 Mori et al.
6,875,080 B2 * 4/2005 Gast, Jr. ..... G01M 17/024 451/254
2008/0108283 A1 * 5/2008 Poling, Sr. ..... B24B 5/366 451/258
2008/0271384 A1 * 11/2008 Puthanangady ..... B24B 53/017 51/309
2012/0122374 A1 5/2012 Honold et al.
2013/0005226 A1 * 1/2013 Watanabe ..... B29D 30/54 451/451

* cited by examiner

IN SITU GRINDING APPARATUS FOR RESURFACING RUBBER BELTS AND ROLLERS

BACKGROUND OF THE INVENTION

1. Field of the Invention

This invention is directed to a grinding apparatus for resurfacing of a rubber belt or roller while the belt or roller remains on the production line.

2. Background of the Invention

Sanforizing is a process of finishing fabric that enhances the appearance and feel of the fabric. The process ensures that the fabric will not shrink when laundered. Sanforizing is performed on fabric prior to cutting and assembling clothing. Through the sanforizing process, the fabric is heated and compressed, which causes the fibers to relax, or shrink. In this way, sanforized fabric will resist shrinkage during ironing, wearing, and especially, washing.

A sanforizer employs a seamless or endless rubber belt in a shrink zone as part of the preshrinking process. A typical endless rubber belt will have an inside circumference of 13 feet, a thickness of approximately 2.625 inches, a width of between 60 inches and 144 inches, and a weight of between 1,300 pounds and 1,700 pounds. The belt typically moves through the shrink zone at between 40 yards per minute (ypm) and 100 ypm. In the shrink zone, the belt is subjected to substantial compressive, tensile, and thermal forces. At the nip point, the belt experiences 10,000 pounds of compression per linear inch of width and as much as 22% elongation stretch. Additionally, the belt is exposed to temperatures ranging from 240° F. to 295° F. The high operating speed, extensive stresses, and elevated temperatures deteriorate the surface of the belt during the course of operation. Thus, a typical endless rubber belt will need to be resurfaced every 500,000 yards to 1,000,000 yards. As such, the belt requires resurfacing every 200 to 400 hours of use, resulting in a loss of production hours.

Resurfacing is performed to produce a pattern on the rubber belt surface, such as a scale-like pattern, and to renew the surface rubber's essential characteristics. The scale provides the necessary friction between the fabric and belt to draw the fabric through the sanforizer. The type and depth of the scale on the rubber belt surface affect the traction between the rubber belt and cloth, which is essential to the mechanical compacting of the cloth. Different fabrics can require different scales for proper compaction. The scale also allows for cooling water to be carried by the rubber belt.

Conventional resurfacing techniques involve either on-line or off-line grinders. For instance, off-line stationary lathes can be used to resurface a rubber belt or roller. However, the heavy belt or belt and roller assembly must be removed from the production line and carried to a lathe. This method requires personnel to move products that can weigh over a ton, and this method requires an extended period of downtime for the sanforizing process.

One on-line method for resurfacing belts and rollers is to use another roller with an abrasive grinding surface. Currently, this method is, by far, the most popular method for resurfacing rubber belts. The roller has a size that is approximately the same size as the width of the belt or roller that is to be ground. The roller is filled with a liquid coolant. Strips of silicon carbide grinding cloth are spirally wound around the roller to provide an abrasive surface. As the roller rotates counter to rotation of the belt, the grinding roller abrades the entire width of the belt at the one time. This method also requires the use of a solid lubricant, such as talcum power.

Conventionally, up to 50 pounds of talcum powder is required to properly lubricate the resurfacing process.

However, using an abrasive grinding roller has several disadvantages. First, this method typically produces an uneven scale on the belt. Because of the large area of contact between the belt and roller, the belt surface tends to bounce away from the grinding roller, which produces horizontal chatter marks. Second, roller requires an electric motor with 15-25 hp, which increases the energy costs associated with the resurfacing process. Third, this method generates a lot of heat, causing rubber reversion, in which the rubber reverts to the gum state. Reversion causes the surface properties of the belt to change detrimentally. Poor surface properties negatively affect the cloth appearance and necessitate more frequent resurfacing.

Third, the talcum powder is difficult to contain. A large amount of talcum powder is necessary to lubricate the rubber belt and grinding roller. During resurfacing, talcum powder can spread over an area having a radius of 50 feet or more. The powder is an irritant to nearby workers, settles in the surrounding machinery, coats finished fabric, and creates a workplace hazard. In practice, the cleanup procedure for the talcum powder can take several hours after resurfacing.

Finally, the roller grinding method takes at least four hours (sometimes longer than eight hours) to complete. Often, the process has to be stopped so that the grinding cloth can be tightened and so talc and rubber dust can be removed from between the grinding cloth and the roller.

Another, less popular on-line method uses abrasive grinding belts that are essentially akin to belt sanders. The grinding belts are a few inches in width, and the grinding belts traverse the length of the belt or roller. However, grinding belts are known to have a poor rubber removal rate, they generate a large amount of heat (which can lead to rubber reversion and its associated problems), and the grit on the grinding belt quickly builds up rubber shavings.

Thus a need exists in the art for a grinding apparatus that can operate on-line, provide a uniform scale on a rubber belt, minimize sanforizer downtime, reduce energy consumption and labor costs, consistently provide high quality rubber surface, and decrease the amount of cleanup associated with the resurfacing process.

SUMMARY OF THE INVENTION

An object of the present invention is to overcome the disadvantages of conventional grinding apparatuses designed to resurface the rubber belts and rollers used in the sanforizing process.

Another object of the present invention is to provide a grinding apparatus that can grind a rubber belt or roller while the belt or roller remains on the production line. A feature of the present invention is that the grinding apparatus uses a relatively small grinding wheel that traverses a track in front of the rubber belt or roller. An advantage of the present invention is that the heavy rubber belt or roller does not have to be removed from the production line when it needs to be resurfaced. A further advantage of the present invention is that danger to personnel during resurfacing and the downtime of the machinery is substantially reduced.

Still another object of the present invention is to provide an improved grinding surface. A feature of the present invention is that the grinding apparatus uses a grinding wheel instead of a grinding roller or grinding belt. Another feature of the present invention is that the grinding wheel is made of steel with a tungsten carbide grit coating. An advantage of the present invention is that the grit of the grinding wheel does not accumulate rubber particles, the grinding wheel does not produce a large amount of heat, and the grinding wheel is able to maintain good contact with the surface of the rubber belt or roller. Additionally, the tungsten carbide grinding wheel has a long life, which reduces the lifetime operation costs associated with this method.

A further object of the present invention is to provide an automated system to grind a rubber belt or roller. A feature of the present invention is that the grinding apparatus is mounted on a motorized track that automatically and precisely traverses the grinding apparatus along the width of the rubber belt or roller. Another feature of the present invention is that the angle of the grinding apparatus and the depth of the cut can be preprogrammed or adjusted. An advantage of the present invention is that the grinding apparatus can be operated by a single person and the resurfacing process takes considerably less time to complete.

Yet another object of the present invention is to provide a grinding apparatus that greatly reduces the downtime of the sanforizer. Features of the present invention that help reduce the downtime include: the grinding apparatus operates on the production line; the grinding apparatus is automated; the grinding apparatus does not require any lubricant; and the grinding apparatus works in conjunction with an efficient dust collection means. Advantages conferred by the present invention include: the grinding time and downtime are approximately one to two hours; there is virtually no clean up time required at the conclusion of the resurfacing process because there is no lubricant to collect and the dust collection means captures almost all of the ground rubber; and the process can be initiated by one employee, who does not need to oversee the resurfacing process.

Yet another object of the present invention is to provide an easy to install grinding apparatus that can be used on multiple machines. A feature of the present invention is that the grinding apparatus has a more compact size, smaller power requirements, and lower weight as compared to conventional resurfacing techniques. An advantage of the present invention is that the grinding apparatus can be installed in much less time, moved more easily between machines, and used with existing power sources without additional modification.

The present invention provides an apparatus for resurfacing a rotating elastomer substrate, said apparatus comprising a motorized grinding wheel, said motorized grinding wheel rotating in a direction counter to the rotating elastomer substrate and having an axis of rotation parallel to the axis of rotation of the rotating elastomer substrate, wherein the perpendicular distance between the motorized grinding wheel and the rotating elastomer substrate is adjustable so as to control the amount of elastomer substrate that is removed; and a mount for said motorized grinding wheel, wherein said mount is located proximal to the rotating elastomer substrate that comprises a part of a production line and wherein the mount is capable of traversing parallel to the rotating elastomer substrate.

BRIEF DESCRIPTION OF THE DRAWINGS

The invention together with the above and other objects and advantages will be best understood from the following detailed description of the preferred embodiment of the invention shown in the accompanying drawings, wherein.

DETAILED DESCRIPTION OF THE INVENTION

The foregoing summary, as well as the following detailed description of certain embodiments of the present invention, will be better understood when read in conjunction with the appended drawings.

As used herein, an element step recited in the singular and preceded with the word "a" or "an" should be understood as not excluding plural said elements or steps, unless such exclusion is explicitly stated. Furthermore, the references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

While the embodiments described herein relate to the sanforizing application, the grinding apparatus can be used in any technical field where a refinishing of a work piece surface is beneficial.

Figure 1A:
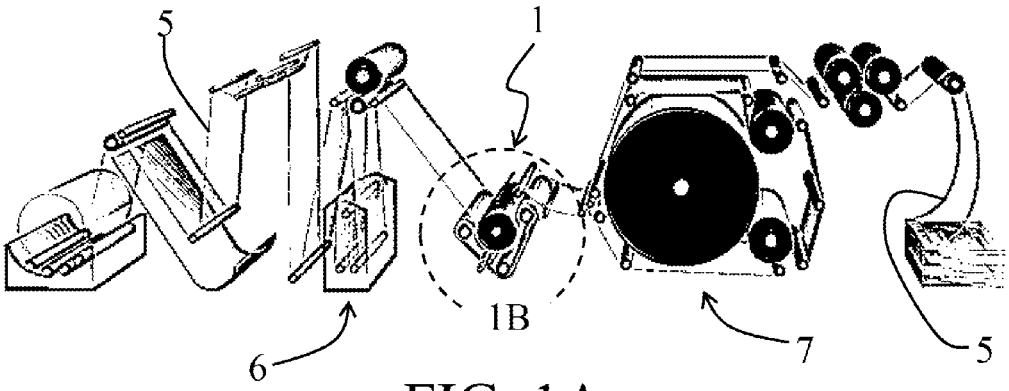
FIG. 1A (prior art)
FIG. 1A is a prior art figure of a sanforizer production line.
Figure 1B:
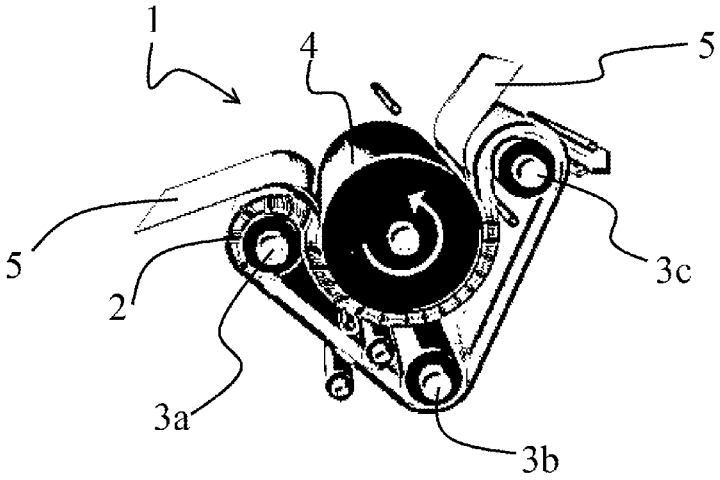
FIG. 1B (prior art)
FIG. 1B is a detail view of the shrink zone of a the production line pictured in FIG. 1A.

The present invention is directed to a grinding apparatus 10 (shown in FIG. 2) for resurfacing of rubber belts and rollers while the belt or roller remains on the production line. FIG. 1A shows a schematic of a sanforizing process production line. FIG. 1B shows a close-up view of the shrink zone 1 of the sanforizing process. In the shrink zone 1, an endless rubber belt 2 is supported by a first roller 3*a*, a second roller 3*b*, and a third roller 3*c*. The three rollers 3*a-c* are arranged in a substantially triangular configuration. Typically, the positions of the rollers 3*a-c* are adjustable horizontally and vertically to change the pressure and tension on the cloth. A heated shrinking cylinder 4 is placed above the second roller 3*b* and between the first roller 3*a* and the third roller 3*c*. As can be seen in the embodiment shown in FIG. 1B, the shrinking cylinder 4 rotates counterclockwise, which causes the belt 2 and three rollers 3*a-c* to rotate in a clockwise fashion. A length of fabric 5 is continuously fed from a moisturizer 6 (as shown in FIG. 1A) into the nip point between the belt 2 and the shrinking cylinder 4. The length of fabric 5 passes out of the shrink zone 1 near the third roller 3*c* and travels down the production line to a dryer 7 (FIG. 1A), and the fabric is then folded or rolled at the end of the line.

Figure 2:
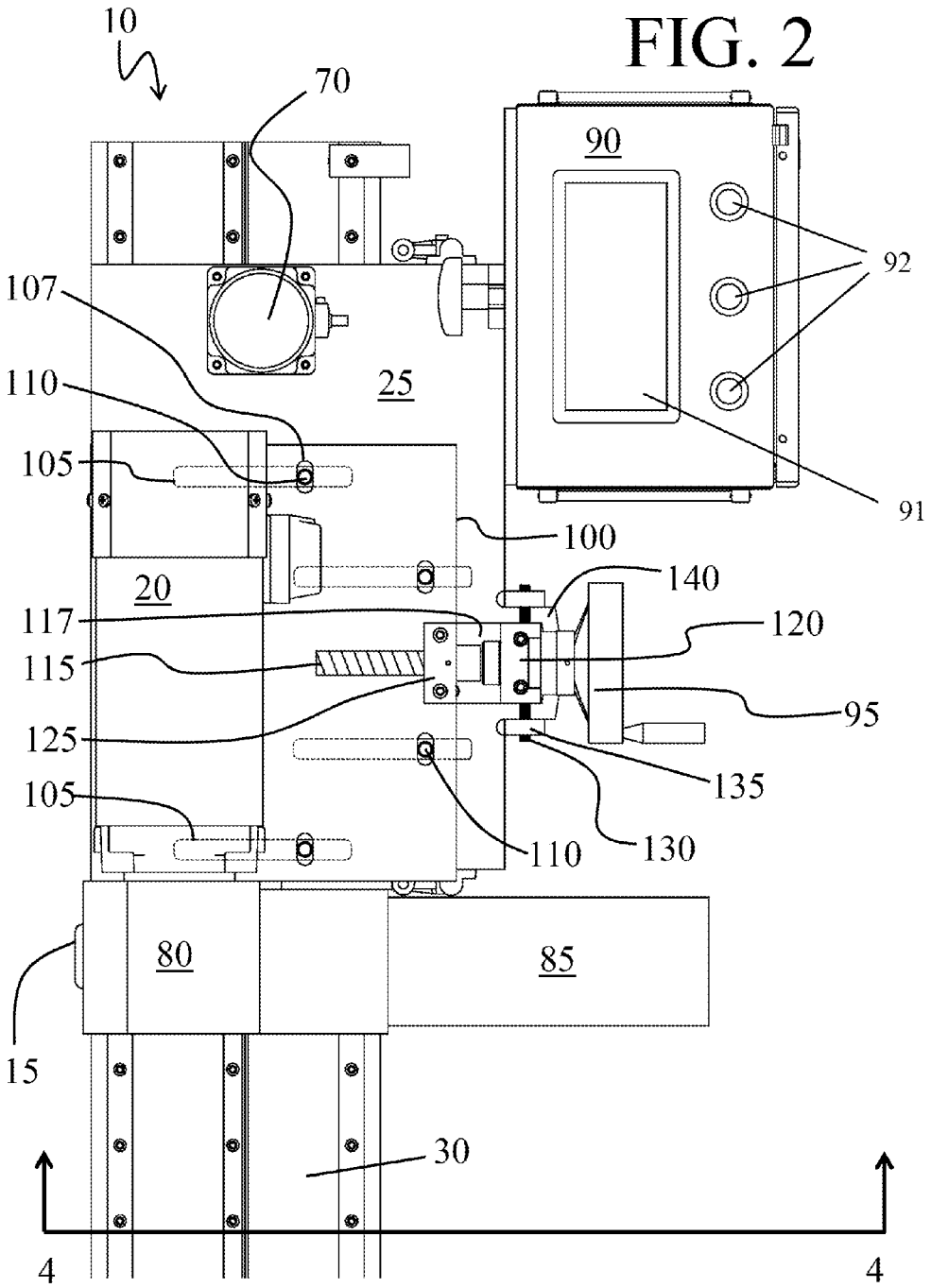
FIG. 2 depicts a grinding apparatus in accordance with the features of the present invention.

The presently invented grinding apparatus is placed proximal to where the belt 2 rounds the first roller 3*a*. As can be seen in FIG. 2, the grinding apparatus 10 is generally comprised of a grinding wheel 15, a motor 20, a mount 25, and a track 30.

Figure 3A:
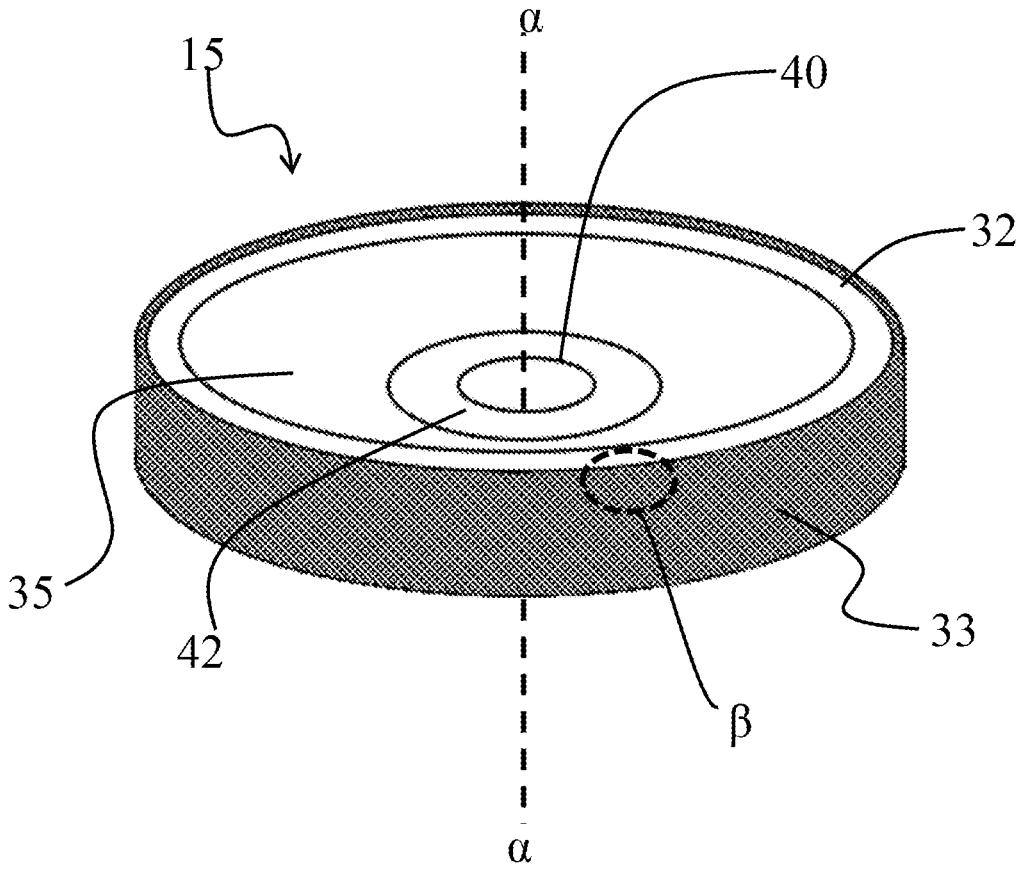
FIG. 3A is a perspective view of a grinding wheel that can be used with the present invention.

FIG. 3A depicts a perspective view of the grinding wheel 15. As can be seen in FIG. 3A, the grinding wheel is a substantially toroidal disc. A peripheral region 32 of the grinding wheel 15 features an externally-facing grinding surface 33. Preferably, the grinding surface 33 extends over the lip of the peripheral region 32 so that the edges of the grinding wheel 15 can be used when the contact angle is varied. The grinding wheel 15 features an interior region 35 that is recessed in some embodiments, with the recess being present on one or both sides of the grinding wheel 15 as depicted in FIG. 3A. The interior region 35 of the toroidal disc defines a transverse aperture 40 formed through a flat surface 42 at the lowest point of the recessed interior region 35.

Typically, the grinding wheel 15 has a diameter of between six and seven inches and a grinding surface 33 width of between one and three inches; however, larger or smaller grinding wheels could be used depending on the application.

In a preferred embodiment, the grinding wheel 15 has a steel body with a tungsten carbide grit coating. However, other grinding wheels having grinding surfaces with abrasives such as alumina-zirconia, silicon carbide, boron carbide, corundum, ceramic iron oxide, diamond powder, cubic boron nitride, and ceramic aluminum oxide, among others, could also be used. Different grinding wheels, including grinding wheels with different grit sizes, can be used to produce different scales on the rubber belts or rollers. Additionally the rotational speed of the grinding wheel can be adjusted to produce a different scale. In this embodiment, the slower rotational speeds produce rougher scales.

Figure 3B:
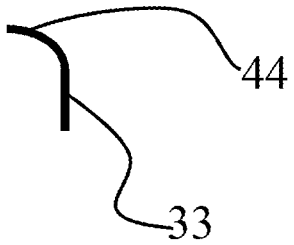
FIG. 3B is a cross-section view of the area depicted by β in FIG. 3A.

The profile of the edge of the grinding wheel is shown in FIG. 3B, according to one embodiment. The externally facing grinding surface 33 curves upwards and towards the interior of the grinding wheel in this embodiment, forming a curved lip 44. The curved lip facilitates a smooth grinding if the wheel is tilted. Without a curved lip 44, a point contact would be made and would leave undesirable spiral line patterns. The curved lip 44, enables the wheel to remove material as the wheel traverses side to side or when the wheel moves parallel to the surface. When the wheel is moving in and out with respect to the belt, the main grinding surface 33 is used, however during such lateral motions, the lip 44 makes contact with the belt.

Returning to FIG. 2, the grinding wheel 15 is in mechanical communication with the motor 20. The motor 20 transfers mechanical energy to the grinding wheel 15 through a driveshaft. The driveshaft is inserted through the aperture 40 of the grinding wheel 15 and is secured to the grinding wheel 15 in a variety of suitable ways. Typically the end of the driveshaft is threaded, and it extends past the grinding wheel 15 in such a way that the grinding wheel 15 can be secured using a flanged nut. Preferably, the grinding wheel 15 is spun using at least a four horsepower motor 20; however, a motor 20 with more or less power could be used depending on the user's need and application. In this embodiment, the grinding wheel 15 is directly driven by the motor, and so the interface between the endless rubber belt and the grinding wheel 15 experience less vibration, which reduces the chances of producing an unevenly ground surface.

The grinding wheel 15 confers an important advantage on the present invention, namely that the grinding wheel 15 has a much longer operational life. Other grinding apparatuses, such as those that use abrasive wraps, abrasive belts, or ceramic stones, will need to have the abrasive element replaced or dressed with an abrasive powder, such as diamond powder, several times during the lifetime of the apparatus. Thus, the present invention reduces the cost of the resurfacing process by diminishing downtime and decreasing the cost of operation. Nevertheless, some fabrics require a specific scale on the endless rubber belt to provide the proper amount of friction. In those instances, the grinding wheel 15 can more easily and more quickly be replaced than other conventional abrasive elements. In one embodiment, the wheel 15 is removed and replaced by a wheel having a different grit type or size.

The motor 20 is secured to a mount 25. The motor 20 and mount 25 can be separate components that are joined together, or the motor and mount 25 can be integrally formed into a single piece. The mount 25 engages the track 30. The track 30 runs parallel to the width of the belt or roller. The mount 25 traverses the width of the belt or roller via the track 30. The mount 25 can travel along the track 30 using a variety of systems, including a rack and pinion system; a worm gear; or a rodless cylinder; or a carriage and rail system with the carriage driven by a linear electric motor, hydraulic or pneumatic arm, electromagnetic force, conveyor belt, or a pulley system, among others. A preferred embodiment of the track 30 and mount 25 uses a rack and pinion system, which will be described for illustrative purposes below.

Figure 4:
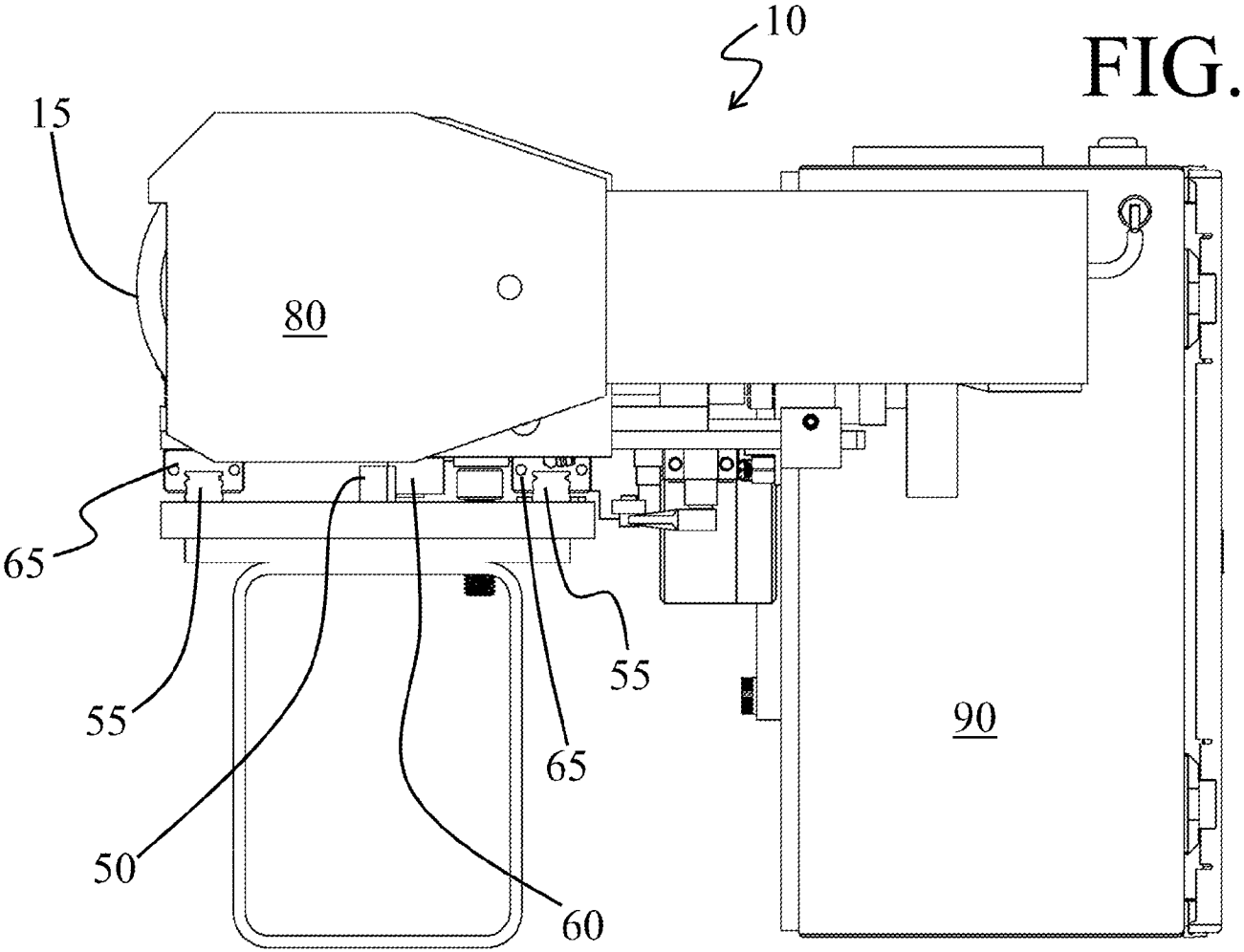
FIG. 4 depicts a view of the grinding apparatus along line 4-4 as shown in FIG. 2.

As can be seen in FIG. 4, the track 30 is comprised of three linear rails, 50 and 55. The middle rail is the rack 50, and the outside rails are guide rails 55. On the underside of the mount 25 is at least one pinion 60 and linear bearings 65. The pinion 60 engages the rack 50, while the bearings 65 engage the guide rails 55. The pinion 60 is driven by a separate pinion motor 70 (as shown in FIG. 2) that is secured to the mount 25. The pinion motor 70 is typically smaller and less powerful than the motor 20 that turns the grinding wheel 15. A suitable pinion motor 70 has a power rating of less than one horsepower, allowing for precise and adjustable rotation speed.

The grinding apparatus 10 will run along the track 30 at a constant speed set by the pinion motor 70. The grinding apparatus 10 stops automatically after reaching either end of the track 30. As can be seen in FIG. 5B, the stopping action is facilitated by a set of travel limit switches 74 and stops 76. In a preferred embodiment, two switches 74 are mounted on the underside of the base 25 at opposite edges. The stops 76 are mounted at both ends of the track 30. In that way, as the grinding apparatus 10 travels down the track, a switch 74 will encounter a stop 76, shutting off the pinion motor 70. An opposing switch 74 will encounter the stop 76 at the other end of the track 30 when the grinding apparatus 10 is moving in the opposite direction. A variety of limit switches and stops can be used, including a lever switch, roller plunger, whisker, reed, and proximity switches. In another embodiment, in place of a limit switch, the track and grinding apparatus incorporate position-aware sensors which stop the grinding apparatus as it nears the end of the tracks. In one such embodiment, the track incorporates an active RFID tag and the grinding apparatus incorporates an RFID reader which detects the position of the tag.

Returning to FIG. 2, the grinding apparatus 10 can also optionally feature a dust collector for collecting the elastomer dust. The dust collector comprises a housing 80 that surrounds the grinding wheel 15, a conduit 85, a suction device (not shown), a particulate container (not shown), and a hose (not shown) that connects the conduit 85 to the suction device and particulate container. As the grinding wheel 15 abrades the surface of the belt, rubber particulate will be created. The suction device of the dust collector lowers the pressure in the housing 80, creating suction. The particulate is sucked into the housing 80, down the conduit 85, and through the hose to the particulate container. The dust collector can be a pre-existing system that is adapted for use with the grinding apparatus 10. Even using a conventional dust collector in conjunction with the presently invented grinding apparatus 10 results in little to no cleanup upon completion of the resurfacing process. The suction required by the dust collector is much lower than in prior art systems inasmuch as the present system does not require talcum powder, in one embodiment, and only a limited quantity of talcum powder in another embodiment. A variety of suitable dust collectors could be used, from a standard shop vacuum up to a 1.5 hp dust collector like those used in the woodworking industry. Further, the grinding zone is small and concentrated within the housing 80, which also lessens the required suction power.

The motor 20, pinion motor 70, and dust collector are all electrically powered. These systems can be connected to a single control system 90; or they can operate as separate systems. As depicted in FIG. 2, the control system 90 comprises electromechanical components housed in a container that is in electrical communication with the motor 20, pinion motor 70, and dust collector. The control system 90 is configured to control the speed at which the motor 20 spins the grinding wheel 15 and the speed at which the pinion motor 70 causes the mount 25 to travel back and forth along the track 30. The control system 90 could also be configured to control activation of the dust collector.

In one embodiment, the control system 90 also includes sensors to track the status of the endless rubber belt. In one embodiment, the control system 90 accepts historical data regarding the belt and measures current use. Accordingly, the control system 90 can signal the user when the belt needs resurfacing or replacing, based on historical, current, and extrapolated future use. In one embodiment, the control system 90 is in communication with a depth sensor, such as a scanning laser or a probe tip. If the depth sensor senses that a preprogrammed limit for the difference in measured highs and lows has been exceeded, then the control system will signal to the operator that a resurfacing needs to be performed. Additionally, the control system tracks the time between resurfacing, such as by monitoring the yards of cloth that are sanforized or the revolutions of the rollers. In another embodiment, the control system 90 includes a camera which records information about the surface of the rubber belt to determine if a resurfacing is required. Additionally, as can be seen in FIGS. 2 and 5A-B, the housing for the control system 90 contains a display 91 and dials or buttons 92, in one embodiment.

The amount of material removed from the belt is user-controlled, either directly or through input to the control system 90. In one embodiment of the invented grinding apparatus 10, the depth of the resurfacing is set using a manually operated wheel crank 95. In a preferred embodiment, the wheel crank 95 has a dial indicator that allows for the user to measure the high and low spots prior to grinding. Preferably, the user then sets the wheel crank 95 to a depth just deep enough to bring the belt or roller surface even with the low spots as measured on the dial. In one embodiment, the measurement is performed by bringing the grinding wheel into contact with the belt surface at various test areas to find a local minima. In this embodiment, the grinding wheel includes a sensor to determine that it has made contact with the belt, such as by determining that there is resistance during turning of the wheel.

Figure 5A:
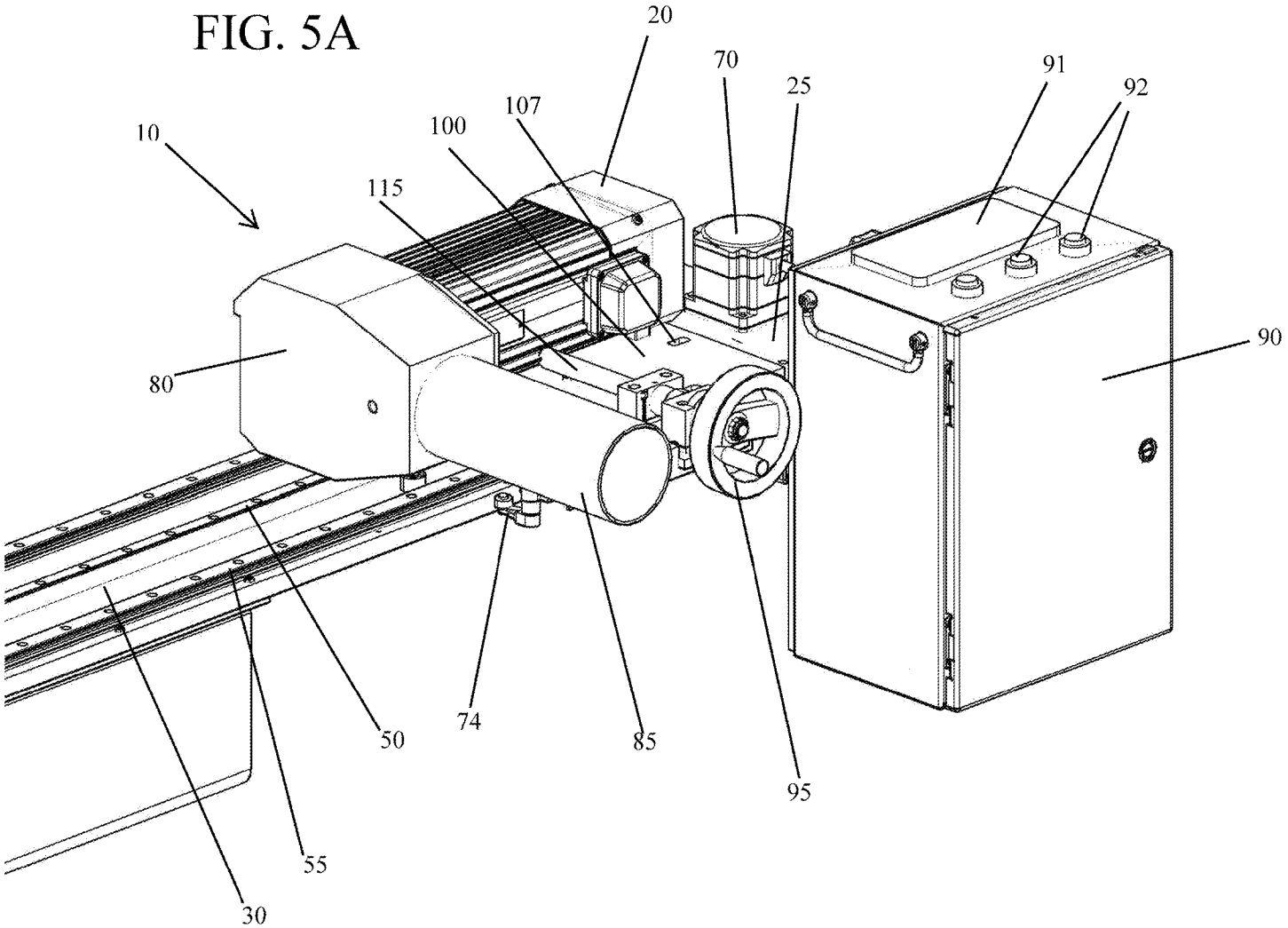
FIGS. 5A-C depict a variety of perspective views of the grinding apparatus in accordance with the features of the present invention.
Figure 5B:
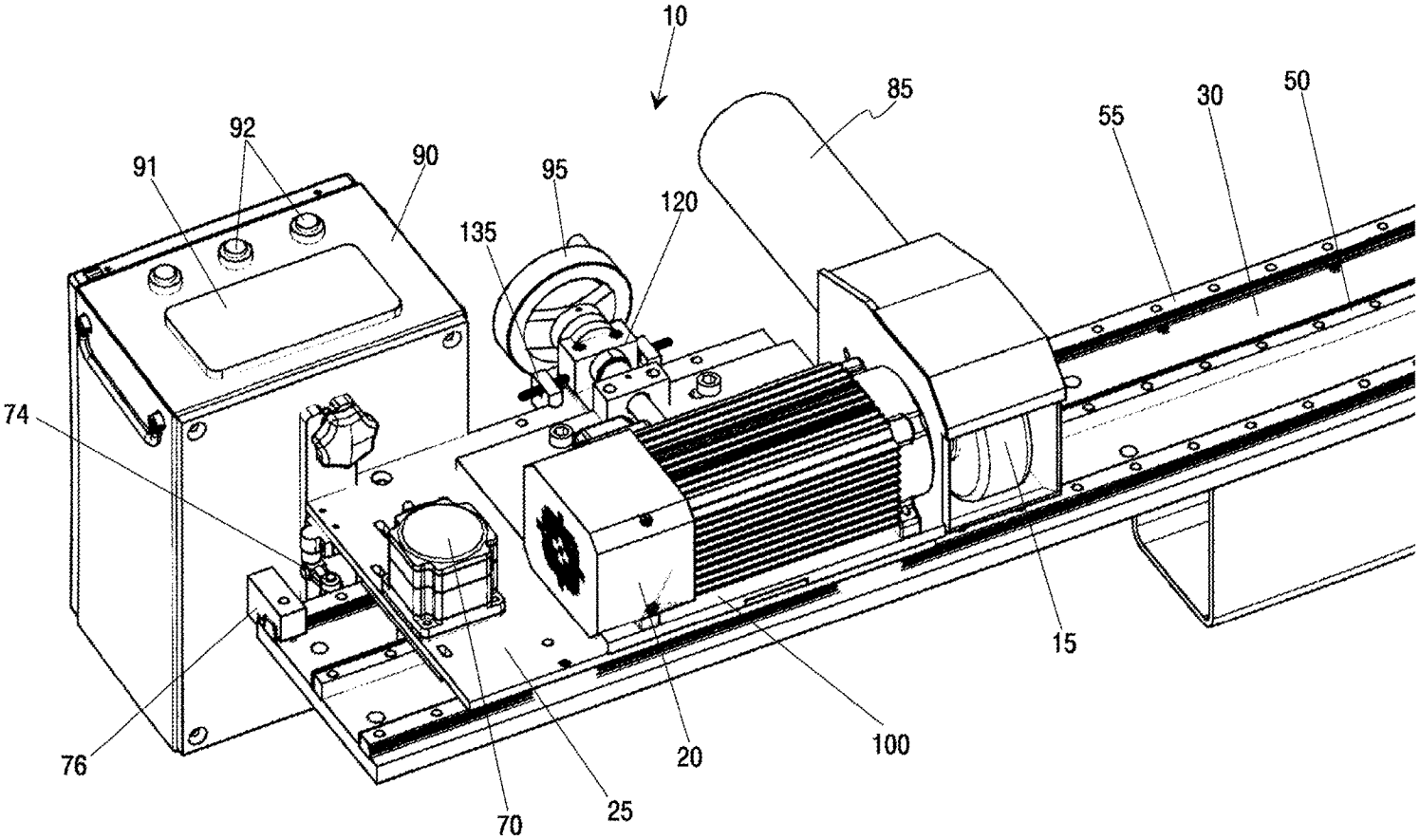

As depicted in FIGS. 1B, 2 and 5A, in this embodiment, the mount 25 has a movable base 100 on which the motor 20 is attached. The movable base 100 slides towards and away from the endless rubber belt, while the mount 25 remains stationary. A variety of means can be utilized to allow movement of the movable base 100 on the mount 25. For instance, as depicted in FIG. 2, the mount 25 has four slots 105 that are machined through its thickness, and the moveable base has four through holes 107 of a distance apart that corresponds to the separation of the four slots 105. The mount 25 and moveable base 100 are preferably fixed relative to one another using a nut and bolt combination 110 in which the bolts are inserted through the through holes 107 and slots 105 and each bolt is secured in place with a nut. In one embodiment, the through holes 107 are wider than the width of the slots 105 so as to allow for side-to-side and front-to-back movement of the moveable base 100 relative to the mount in the horizontal plane. This feature will be discussed below as it relates to the contact angle of the grinder to the elastomer substrate.

Movement of the movable base 100 relative to the mount 25 is controlled using the wheel crank 95. The wheel crank 95 is in mechanical communication with a threaded rod 115. A flat projection 117 reversibly extends from a groove in the underside of the movable base 100. Extending upwardly from the flat projection 117 is a first vertical block 120, and extending upwardly from the top surface of the movable base 100 is a second vertical block 125. In one embodiment, both vertical blocks 120, 125 have collinear threaded apertures extending through the thickness of their horizontal surfaces parallel to the axis of rotation for the endless rubber belt. In another embodiment, only one vertical block 125 is threaded. In this embodiment, the threaded block 125 is fixed axially to the non-threaded block 120 with two thrust bearings, allowing screw rotation but not translation.

Beginning at the point farthest from the endless rubber belt, the wheel crank 95 engages the threaded rod 115, which extends through the first vertical block 120 on the mount 25 and then through the second vertical block 125 on the movable base 100. Rotation of the wheel crank 95 will cause the threaded rod 115 to rotate inside the threaded apertures of the first and second vertical blocks 120, 125. Because the mount 25 and first vertical block 120 are stationary, the rotation of the threaded rod 115 will cause the movable base 100 to slide towards or away from the endless rubber belt depending on what direction the wheel crank 95 is rotated. Moving the movable base 100 towards the endless rubber belt will allow for a deeper cut during each pass, while moving the movable base 100 away from the endless rubber belt will create a shallower cut during each pass. In this way, depth of the cut can be set. Further, as shown in FIG. 1B, most sanforizers have a shrinking cylinder 4 that is adjustable in the horizontal plane such that pressure on the belt 2 can be adjusted.

Figure 5C:
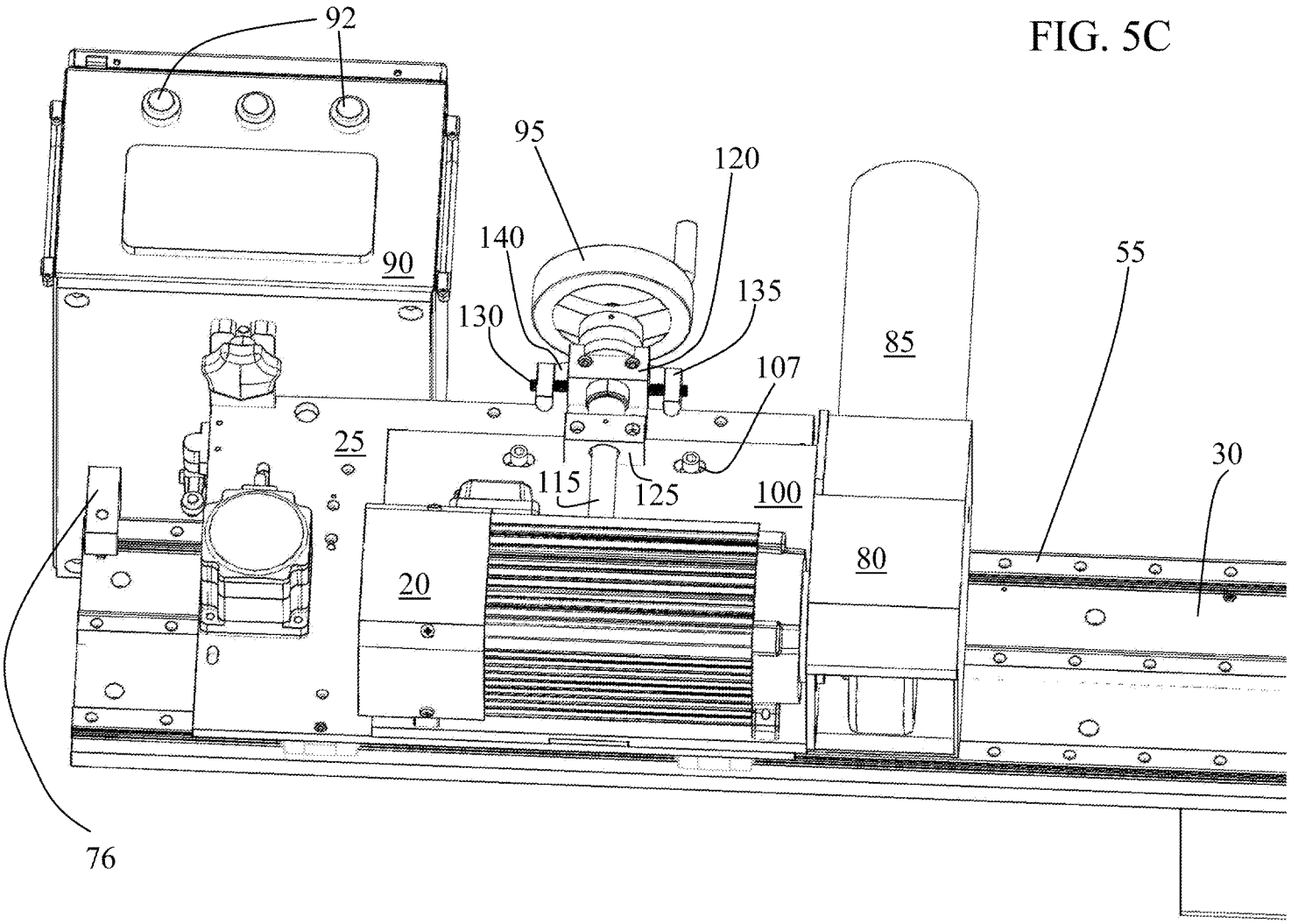

In addition to adjusting the perpendicular distance of the grinding wheel 15 from the endless rubber belt, the angle at which the grinding wheel 15 contacts the endless rubber belt is also subject to adjustment in some embodiments. In a default setting, the horizontal axis a of the wheel 15 (as shown in FIG. 3A) is arranged parallel to the width of the endless belt. However, the axis a can be varied to adjust the angle at which the grinding wheel 15 contacts the endless belt. As depicted in FIG. 2, at least one vertical post 135 has a bolt 130 extending through a threaded aperture in its vertical plane. Preferably, each vertical post 135 has a corresponding bolt 130. The vertical posts 135 are located on either side of a peninsular region 140 that extends from the mount 25. The vertical posts 135 may be integrally molded to the peninsular region 140, or they may be separate components. One end of the bolt 130 contacts the first vertical block 120. Winding the bolt through the aperture in the vertical post 135 causes the first vertical block 120 to move horizontally between the vertical posts 135. A perspective view of this arrangement can be seen in FIG. 5C.

As can be seen in FIG. 2, the through holes 107 are wider than the corresponding slots 105. By securing one through hole 107 and slot 105 using a nut and bolt combination 110, the nut and bolt combination 110 will act as a pinning point upon which the moveable base 100 can pivot. Thus, moving the first vertical block 120 horizontally while one nut and bolt combination 110 is pinned will cause the contact angle of the grinder with respect to the elastomer substrate to change. In one embodiment, the contact angle can change by up to two degrees in either direction. In a more preferred embodiment, the contact angle can change by up to one degree in either direction. In some embodiments, markings are placed on the bolt 130 or on the mount 25 to denote fractions of the degree of rotation. In one embodiment, the flat projection 117 is a sliding guide for the moveable base 100. The flat projection 117 is also affixed to mount 25 with a pin, which allows it to change angle, but not to translate. The two opposing screws 130 are used to pivot the flat projection 117 and in turn change the angle of the moveable base 100 and the motor assembly.

In an exemplary application, the grinding apparatus 10 can resurface a belt having a width of 80 inches in about an hour. During this time, the grinding apparatus 10 removes approximately 0.5 to 1 mm of rubber during each pass. Each pass takes between 1 hour for a smaller rubber belt and 2 hours for a larger rubber belt to complete. The grinding wheel 15 spins at approximately 4000 rpm to 7000 rpm with 5000 rpm in one embodiment. Throughout the process, the grinding wheel 15 is tilted as it traverses from side to side. The tilting of the wheel, even if the tilt angle is only moderate, allows for elimination of visible and undesirable spiral line that would be formed by the trailing edge of the wheel if it did not include the curved lip 44 shown in FIG. 3B. In one embodiment, the rotational speed of the grinding wheel 15 can be varied, either manually or programmatically by the control system 90. Typically, the grinding wheel will rotate between 4000 rpm and 5000 rpm. A slow rotational speed is used for a rougher finish, while a faster rotational speed is used for producing a smoother scale or finish. Typically, the entire resurfacing process can be completed in one to two hours with no additional cleanup time required. The tilting function combined with adjustment of the wheel provides for fine tuning of the process, grinding conditions, and the material being removed.

While the foregoing discussion has primarily considered endless rubber belts 2 used in a sanforizing process, the presently invented grinding apparatus 10 has applicability in other industries where rubber or urethane belts or rollers need resurfacing. For instance, paper mills and printing presses use rubber rollers that need resurfacing from time to time. The present invention can be used for these applications, and other applications are easily inferred.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

The present methods can involve any or all of the steps or conditions discussed above in various combinations, as desired. Accordingly, it will be readily apparent to the skilled artisan that in some of the disclosed methods certain steps can be deleted or additional steps performed without affecting the viability of the methods.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

An exclusive property right or privilege is claimed in the invention as defined in the following claims:

1. An apparatus for resurfacing a rotating elastomer substrate, said apparatus comprising:

a grinding wheel motor secured to a moveable motor base;

a tilting motorized grinding wheel attached to a driveshaft of the grinding wheel motor, said motorized grinding wheel in direct contact with said rotating elastomer substrate, wherein a distance between the motorized grinding wheel and the rotating elastomer substrate is adjustable so as to control an amount of elastomer substrate that is removed; wherein rate of rotation of said grinding wheel is controlled by a high precision system which in turn controls a pattern impressed on the elastomer substrate; wherein a surface of said grinding wheel defines a curved lip; wherein the resurfaced elastomer substrate features a friction inducing scale pattern; and wherein said moveable motor base is in communication with a fixed motor mount wherein said motor mount is located proximal to the rotating elastomer substrate; wherein said motor mount comprises a rail system and said moveable motor base moves linearly across said rail system; wherein said moveable motor base slides towards and away from the rotating elastomer substrate by repositioning of fixed bolts extending from the motor mount through apertures defined in moveable motor base; wherein moveable motor base is selectably tilted by extension of flat projections from said motor mount.

2. The apparatus of claim 1 wherein the motorized grinding wheel can be adjusted to further vary a contact angle of motorized grinding wheel relative to the rotating elastomer substrate.

3. The apparatus of claim 2 wherein a rotation speed of the motorized grinding wheel can be varied.

4. The apparatus of claim 1, wherein the grinding surface of the motorized grinding wheel is tungsten carbide coated steel.

5. The apparatus of claim 1, wherein the mount is in mechanical communication with a track that is parallel to the axis of rotation of the rotating elastomer substrate.

6. The apparatus of claim 5, wherein the mount is motorized such that it can automatedly travel along the track.

7. The apparatus of claim 1, further comprising a means for collecting particulate generated during the resurfacing process.

8. The apparatus of claim 1, further comprising a control system wherein said control system is configured to record and store information about the resurfacing of the elastomer substrate.

9. The apparatus of claim 8, wherein the control system records information including but not limited to the number of resurfacing processes, the depth of each cut, the speed at which the grinding wheel rotated, and the speed at which the mount traveled along the track.

10. The apparatus of claim 1, wherein the perpendicular distance between the motorized grinding wheel and the rotating elastomer substrate is adjusted manually.

11. The apparatus of claim 1, wherein the perpendicular distance between the motorized grinding wheel and the rotating elastomer substrate is adjusted automatically by the control system.

12. The apparatus of claim 10, wherein the perpendicular distance between the motorized grinding wheel and the rotating elastomer substrate is adjusted manually using a wheel crank.

13. The apparatus of claim 1, wherein the mount traverses parallel to the rotating elastomer substrate using a track system.

14. The apparatus of claim 13, wherein the track system is selected from the group consisting of a rack and pinion system, a linear electric motor, an hydraulic arm, a pneumatic arm, an electromagnetic force, a conveyor belt, a pulley system, a worm gear, and a rodless cylinder.

15. An apparatus for resurfacing a rotating elastomer substrate, said apparatus comprising:

a grinding wheel motor;

a fixed motor mount wherein said motor mount is located proximal to the rotating elastomer substrate being resurfaced and wherein said motor mount comprises a rail system;

a moveable base wherein said grinding wheel motor is secured to the moveable base; wherein said moveable base is in communication with said motor mount; said moveable base moves linearly across said rail system; wherein said moveable base slides towards and away from the rotating elastomer substrate by repositioning of projections from the motor mount in apertures formed in said moveable base; and a grinding wheel attached to a driveshaft of the grinding wheel motor, said grinding wheel in direct contact with said rotating elastomer substrate, wherein movement of the base changes a distance between the motorized grinding wheel and the rotating elastomer substrate so as to control amount of elastomer substrate that is removed; wherein rate of rotation of said grinding wheel is controlled by a high precision system which in turn controls a pattern impressed on the elastomer substrate; wherein the resurfaced elastomer substrate features uniform scale pattern.

16. An apparatus for resurfacing a rotating elastomer substrate, said apparatus comprising:

a grinding wheel motor;

a fixed motor mount wherein said motor mount is located proximal to the rotating elastomer substrate being resurfaced and wherein said motor mount comprises a rail system;

a moveable base wherein said grinding wheel motor is secured to the moveable base; wherein said moveable base is in communication with said motor mount; said moveable base moves linearly across said rail system; wherein said moveable base slides towards and away from the rotating elastomer substrate by repositioning of projections from the motor mount in apertures formed in said moveable base;

a grinding wheel attached to a driveshaft of the grinding wheel motor, said grinding wheel in direct contact with said rotating elastomer substrate, wherein movement of the base changes a distance between the motorized grinding wheel and the rotating elastomer substrate so as to control amount of elastomer substrate that is removed; wherein rate of rotation of said grinding wheel is controlled by a high precision system which in turn controls the pattern impressed on the elastomer substrate; wherein the resurfaced elastomer substrate features uniform scale pattern; and a control system wherein said control system controls amount removed by the grinding wheel in response to contact of the wheel with the elastomer substrate; and an indicator of whether a resurfacing is required.

* * * * *